United States Patent [19]

Chapelain et al.

[11] Patent Number: 5,000,292

[45] Date of Patent: Mar. 19, 1991

[54] METHOD OF MOUNTING A LIFT AND LIFT OBTAINED

[75] Inventors: Jean C. Chapelain, Sainte Genevieve Des Bois; Daniel Beaulieu, Saint Brisson/Loire, both of France

[73] Assignee: Otis Elevator Company, Farmington, Conn.

[21] Appl. No.: 471,339

[22] Filed: Jan. 29, 1990

[51] Int. Cl.[5] ..... B66B 9/00

[52] U.S. Cl. ..... 187/1 R; 52/30; 52/122.1

[58] Field of Search ..... 187/1 R, 6, 95; 182/178, 82, 39, 38, 36; 52/745, 741, 122.1, 30; 29/429, 428

[56] References Cited

U.S. PATENT DOCUMENTS 4,356,890 11/1982 Smart ..... 187/6

FOREIGN PATENT DOCUMENTS 8904807 6/1989 European Pat. Off. ..... 187/1 R 0040449 3/1979 Japan ..... 187/1 R

*Primary Examiner*—Robert P. Olszewski

*Assistant Examiner*—Kenneth Noland

*Attorney, Agent, or Firm*—William W. Jones

[57] ABSTRACT

A temporary pulley assembly is fastened to the ceiling of a lift hoistway, and is used to raise the sheave crossbeam, sheaves, car, and counterweight assembly to the hoistway ceiling. The crossbeam is a telescoping member which is extended to fit into pockets in the hoistway side walls. Installers working on the roof of the car can fix guide rails to the hoistway walls as the entire assembly is being raised en masse. When the assembly reaches the top of the hoistway, the hoisting cables or ropes are properly fastened to the various lift sheaves, and to the hoistway ceiling.

7 Claims, 6 Drawing Sheets

METHOD OF MOUNTING A LIFT AND LIFT OBTAINED

TECHNICAL FIELD

The invention relates to a method for mounting a lift and the lift obtained, which makes it possible, particularly, to assemble in one go the fittings supporting the traction cable pulleys as well as the counterweight guide strings, a cabin guide string, the traction cables placed in their final position and the balancing counterweight.

BACKGROUND ART

In existing methods of fitting lifts with machinery at the bottom of the shaft, a criss-cross arrangement of beams is mounted at the top of the shaft for supporting the traction cables, the cabin guides and the counterweight. Such a method requires assembly on the site of beams of fixed length which must be adapted in size to the shaft of the lift. Handling the beams in the shaft is a delicate operation and not without danger. Stopping up with mortar the positions reserved for the beams makes their isolating supports inoperative. Unwinding of the cables must take place one by one. The cables risk being crossed during assembly and being damaged while dragging on the ground.

The mounting method of the invention overcomes these drawbacks by using a single beam with telescopic arms such as described in the French Patent Application No. 88-15753 filed on Nov. 1, 1988, and entitled "Poutre-support des poulies des cables de traction pour ascenseur" in the name of the Applicant.

This beam comprises the guide pulleys for the traction cables, the cabin balancing counterweight disposed longitudinally at the side, the fixed point plate for the cables on the counterweight side and the tools for suspending the guides from their final position (the two strings of counterweight guides and a cabin guide string).

DISCLOSURE OF THE INVENTION

The method of the invention is characterized essentially by the following successive operating phases:

(a) positioning an instrument for lifting the telescopic arm beam to a suitable position at the top of the shaft;

(b) introduction at the bottom of the shaft of the elements equipping the lift such as counterweight guides and cabin guides, the balancing counterweight, the beam with telescopic arms in a retracted position and the cable drums;

(c) introduction of the cabin into the shaft, positioned on a support adjoining the machinery premises;

(d) lifting the beam by means of said lifting instrument to a suitable horizontal position above the cabin roof, secure with the shaft, so as to suspend the balancing counterweight, the first counterweight guide bars and cabin guide from said roof;

(e) positioning of the lift drive machine and coupling of the cables over the pulleys of the beam and over the pulley of the driving machine, these cables being fixed by their counterweight side end to the fixed point plate on the beam and unwound directly from cable drums at the bottom of the shaft;

(f) raising the beam thus equipped by means of the lifting instrument while continuously fish-plating the guides during lifting, until it reaches its final position at the top of the shaft;

(g) laying the beam on its shaft supports by opening out the arms on to said supports;

(h) recovery of the ends of the cables on the cabin side while lowering the counterweight by an appropriate length, e.g., half way, these ends being passed under the lower cabin pulleys and fixed to its roof; and (i) raising the cabin, the counterweight moving down simultaneously, up to its top position for fastening to the fixed point plate of the cables on the cabin side at the top of the shaft.

The result of this arrangement is that the bars at the top of the shaft, as well as the guide pulleys, the balancing counterweight, the two counterweight guide strings, a string of cabin guides and suitably coupled drive cables may be raised in a single operation for mounting in their final position. It only remains at this stage to complete the mounting of the lift by fitting in a conventional way the second cabin guide string and the movement control and check elements.

Compared with the conventional technique which consists essentially in mounting the equipment elements one after the other, this method of raising the major part of the equipment elements of the lift as well as suitably coupled cables in a single operation provides appreciable savings in time in fitting the lift.

The method of the invention is illustrated hereafter by means of one embodiment with reference to the accompanying drawings, in which:

BEST MODE FOR CARRYING OUT THE INVENTION

Figure 6:
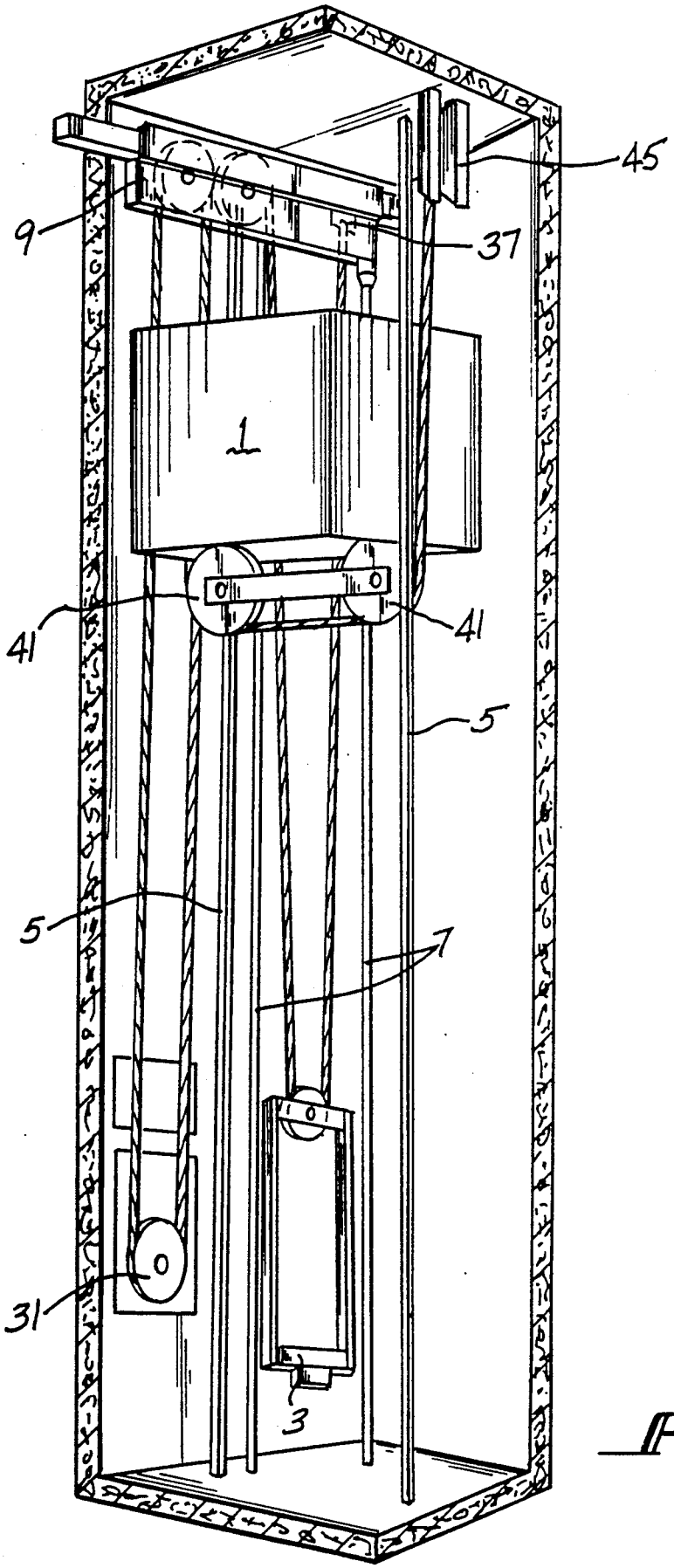
FIG. 6 shows the phase for fixing the end of the coupled cables on the cabin side.

The method of the invention relates to the essential structural and equipment elements of the lift such as shown mounted in FIG. 6; namely, in addition to the cabin 1, and its balancing counterweight 3, the cabin guides 5 and the counterweight guides 7, the beam 9 supporting the guide pulleys 11 and finally the drive cables 13.

Figure 1:
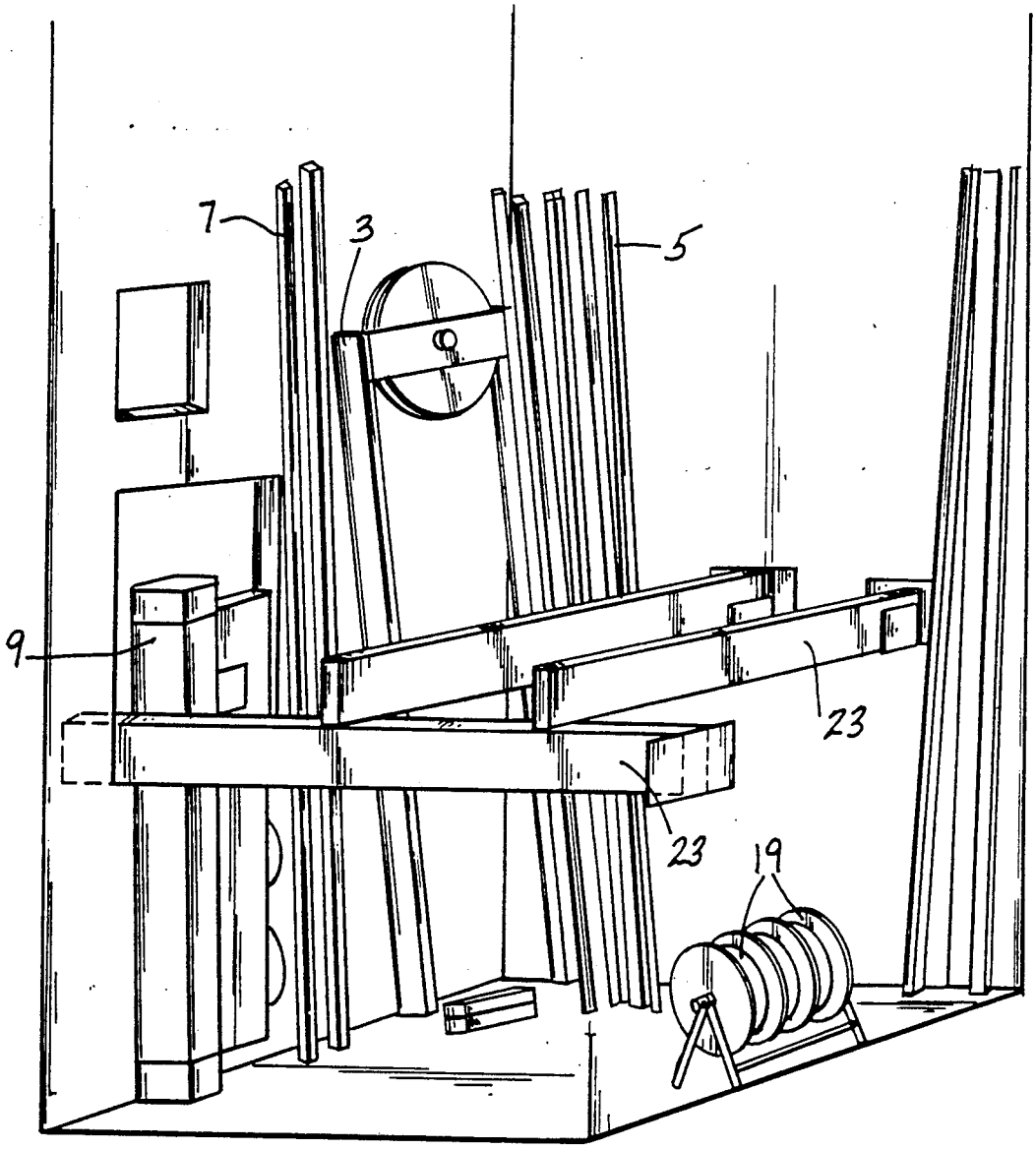
FIG. 1 shows schematically the introduction of the equipment elements of the lift at the bottom of the drive shaft, these elements being assembled in accordance with the method of the invention.
Figure 2:
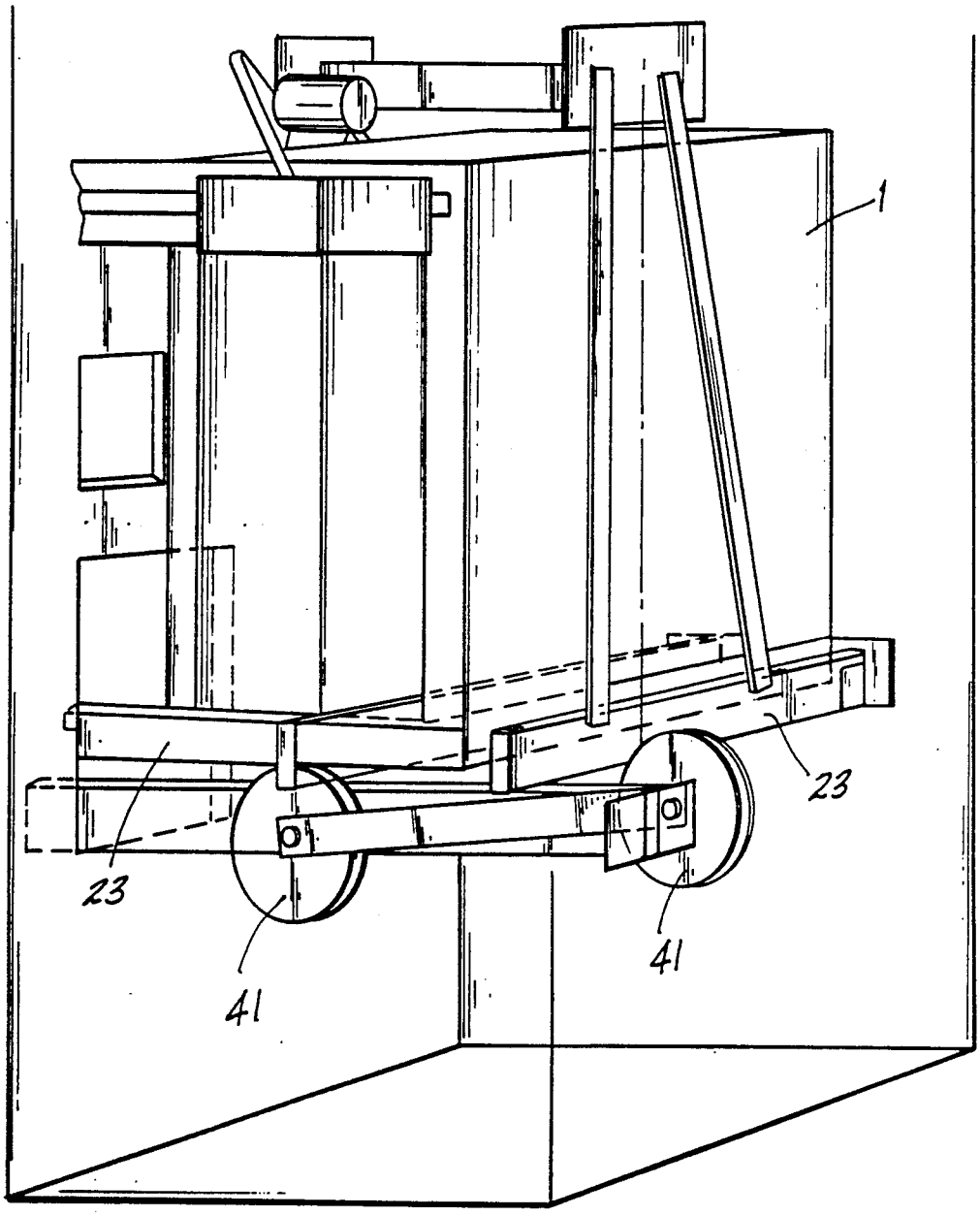
FIG. 2 shows the lift cabin positioned on a temporary support in front of the machinery premises and before coupling of the cables.

Having traced the positioning axes for the elements using the known technique and after installing the beam slinging tool 15 as well as the lifting winch 17 (shown in FIG. 3), the above mentioned equipment elements are introduced at the bottom of the shaft (FIG. 1); namely, the cable drums 19, the beam 9 with telescopic arms 21 (in the retracted position), the counterweight 7 and cabin 5 guides and the balancing counterweight 3. Planks 23 are set up in the shaft for temporarily supporting the cabin (FIG. 2) in a position adjoining the machinery premises 25.

Then, the beam with its retracted arms is raised above the cabin roof and positioned secure with the shaft, e.g., on brackets 27. It is then disposed horizontally at a short distance from the roof, which makes it possible for an operator positioned on the cabin roof to work in all safety and under good conditions. He may then, with the help of a second operator, raise the beam on the slinging tool 15 by its central pulley 11, the lifting cable being driven by the winch suitably secured to the roof for the operator. It is then a question of fastening the counterweight to the beam without weight elements and on its movement axis.

Figure 3:
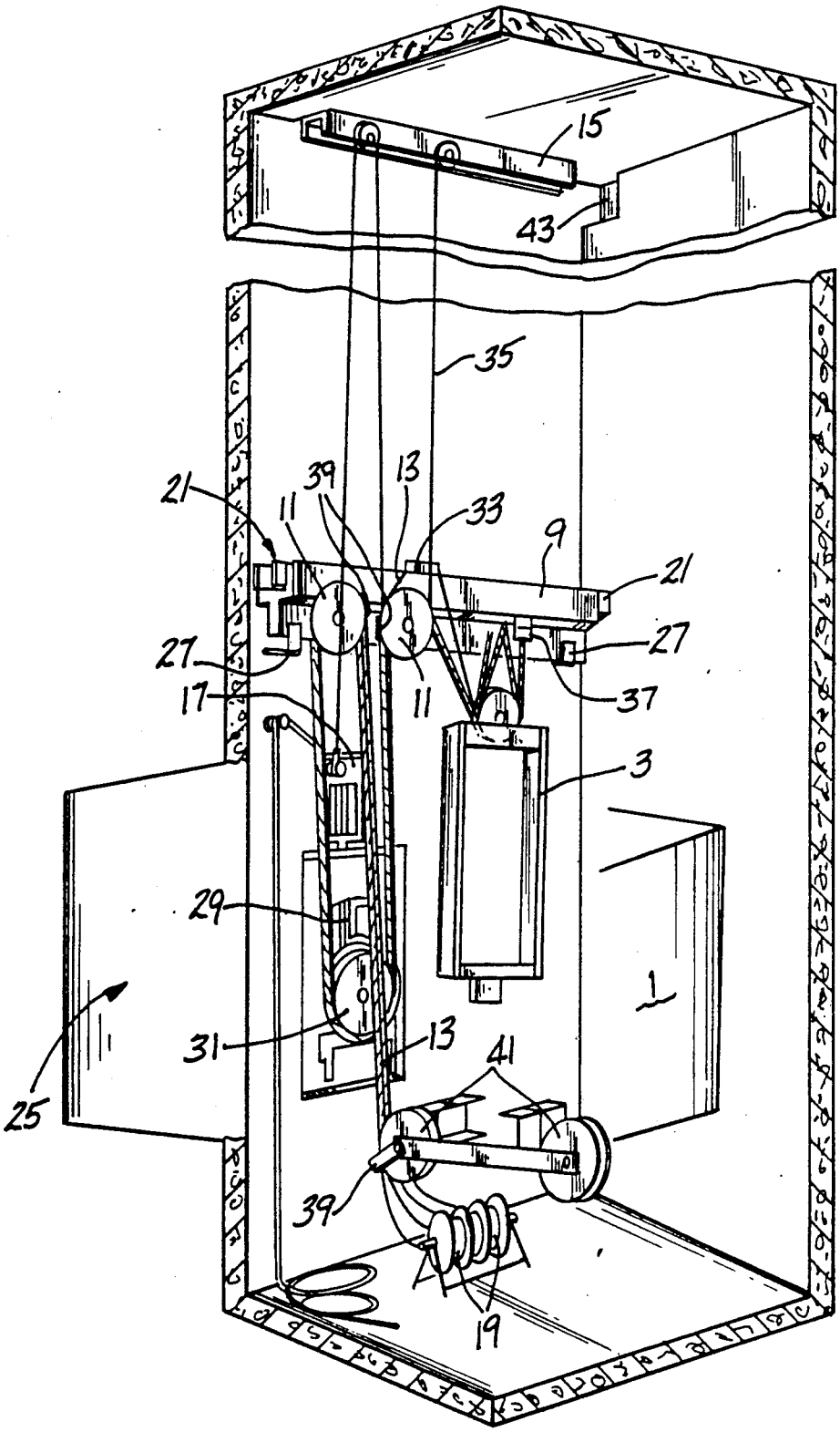
FIG. 3 shows the beam positioned in the shaft with its different equipment elements assembled and ready to be lifted for fitting.

Then, the machine 29 is positioned with its pulley brake released. The cables are then drawn from drums 19, which are disposed in juxtaposition and with the same axis of rotation, and passed in an orderly way in the grooves of machine pulleys 31 and the pulleys of beam 11. One of the cables passes over a diverting piece 33 above the central beam pulley, a groove of the latter being occupied by the beam lifting cable 35. The ends of the cables are connected to the fixed point plate 37 of the beam on the counterweight side by means of eyelet rods. Finally, once the cables are correctly fitted in the grooves of the pulley, by two operators, one at the bottom of the shaft and the other on the cabin roof (so at a short distance from each other, which confers ideal conditions for mounting the cables making it possible to check that they do not become mingled, contrary to the conventional techniques where the cables are unwound one by one over practically the length of the shaft). Cable guards 39 are mounted on the pulleys for preventing the cables from escaping and particularly on the beam pulleys 11, the machine pulley 31 and one of the lower pulleys close to cabin 41. Thus we arrive at the intermediate situation such as shown in FIG. 3 where the cabin is not shown, except its lower pulleys 41, for the sake of clarity of the drawings.

The first counterweight 7 and cabin 5 guide bars (two for the counterweight and one for the cabin) may then be fixed on the corresponding suspension tools fixed to the beam. When this is done, the beam may be raised from the brackets 27. Such raising is carried out using the winch 17 whose cable carries the central pulley 11. The assembly of elements on the beam is in practice balanced relatively to the axis of this central pulley, so that the beam is raised horizontally and in a stable manner.

Figure 4:
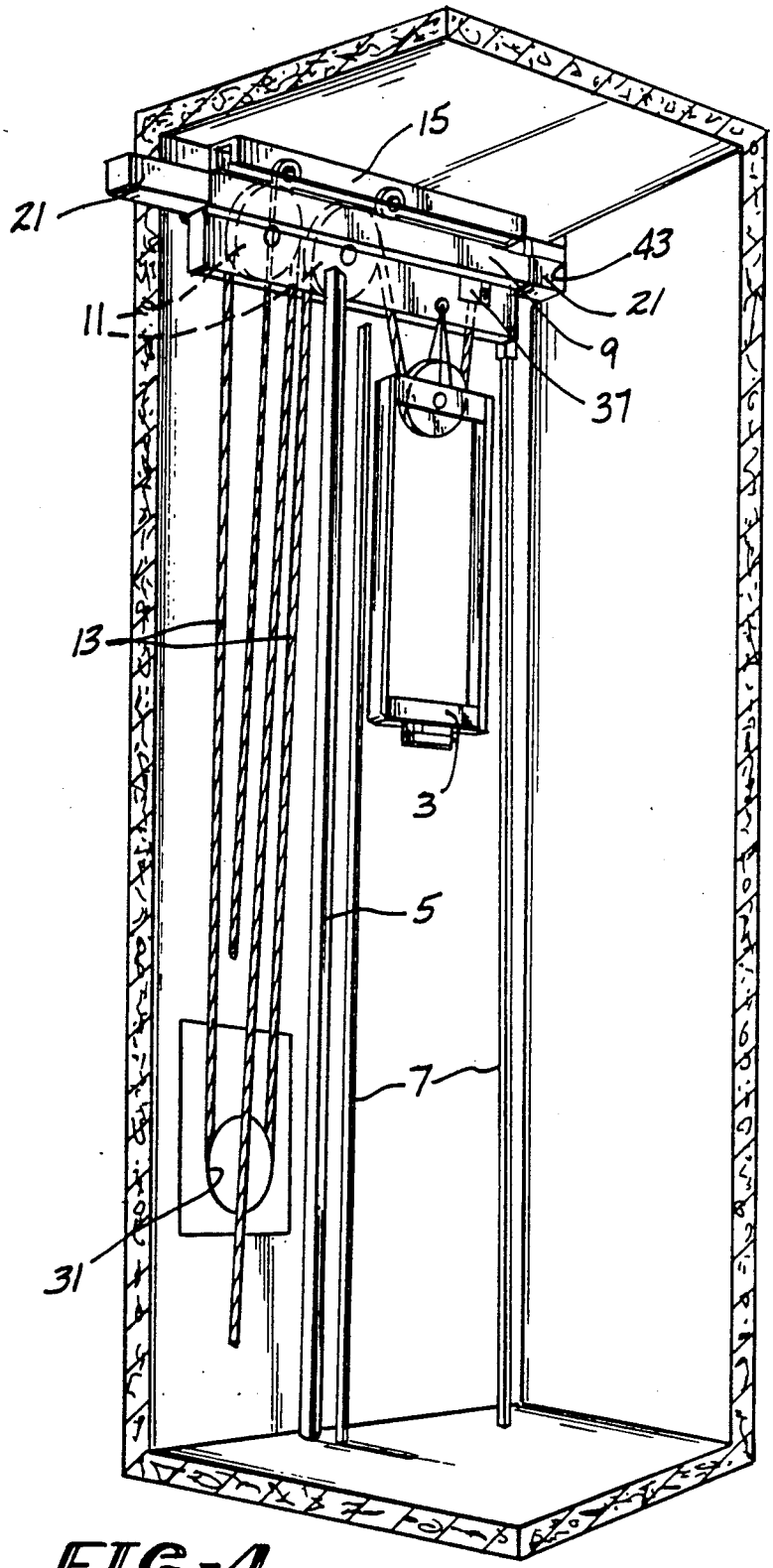
FIG. 4 shows the phase of laying the beam in position.
Figure 5:
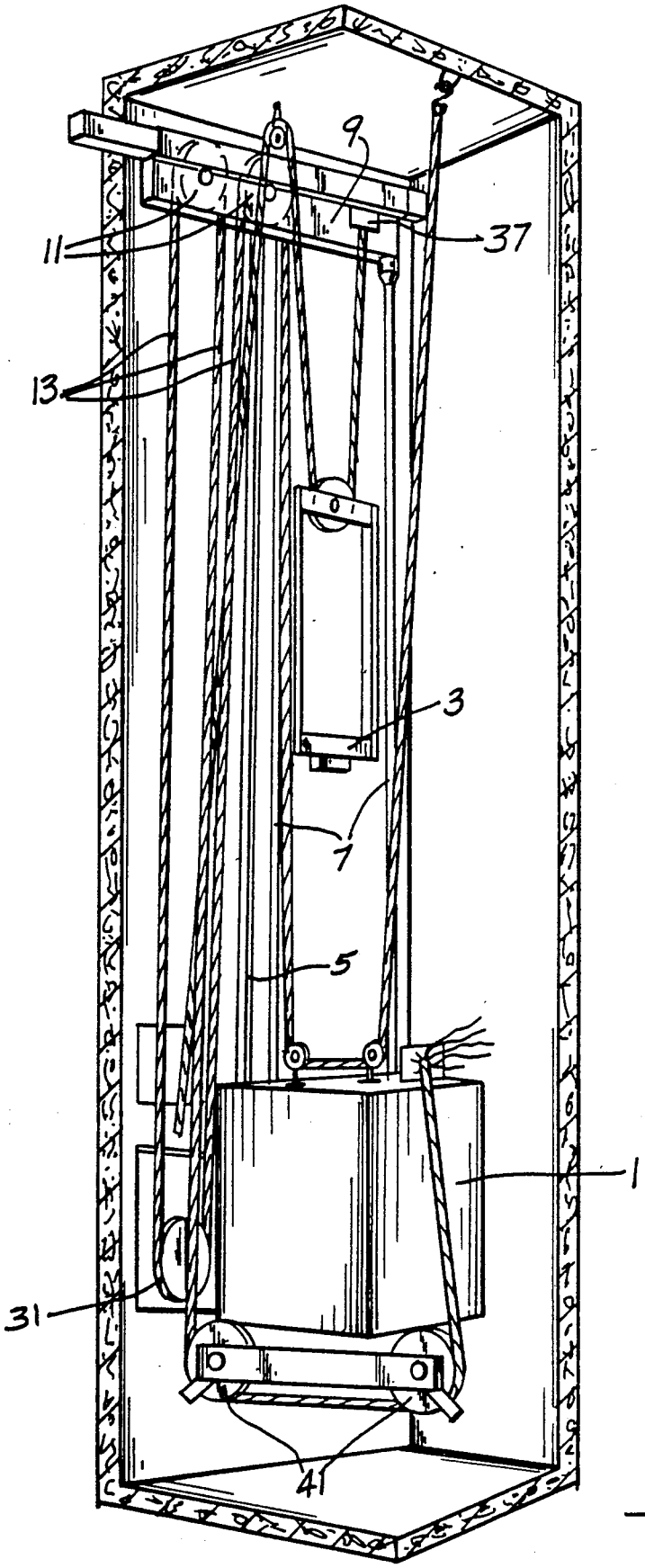
FIG. 5 shows the phase of lifting the cabin with the coupled cables fixed to its roof.

Correction ballasting of the counterweight may be provided if required (by adding weights). As the beam is raised, the guides are fish-plated, from the roof of the cabin, so as to ensure the continuity of lifting of the two counterweight guide strings and of the cabin guide string fixed to the beam. The cables are also unwound simultaneously from the drum. We finally arrive at the top of the shaft (FIG. 4) where the arms 21 of the beam may be opened out to the desired length on their support 43 at the top of the shaft. The beam is now laid in position and correctly applied on its isolating cushions.

The top slinging tool 15 is then withdrawn and the cable 13 passed over the diverting piece 33, positioned in its respective groove of the central pulley 11.

The winching points are then moved for raising the second cabin guide string 5 (shown in FIG. 6), the first bar being fixed to the fixed point plate 45 of the cables on the cabin side. This fixed point plate is fixed with its cabin guide string at the top of the shaft. It is now a question of recovering the ends of the cables on the drums for fixing them to the corresponding above mentioned fixed point plate 45. This is carried out manually by unwinding the cables from their drums and correspondingly lowering the counterweight to about midway of its travel. At this moment, the remaining cable length is passed over the second lower pulley 41 of the cabin and their ends are fixed to the roof 3. The cabin is then raised by winching up to the top position, the counterweight moving down simultaneously, in which position the cable ends are fixed to the fixed point plate 45 on the shaft (FIG. 6).

The structural elements of the lift are then placed in position, essentially by simply raising the beam with its arms folded back in the lift shaft.

A man skilled in the art may find all the technical equivalents of the method or process described and claimed hereafter.

What is claimed is:

1. A method for mounting a lift assembly in a shaft, said lift assembly comprising a beam with pulleys mounted thereon and having telescoping arms which are extendable into support pockets formed in opposite sides of an upper part of the shaft, said method comprising the steps of:

(a) securing hoist pulley means to a top wall of the shaft;

(b) placing guide rails, a counterweight assembly, said beam, and cable drums in the bottom of the shaft;

(c) providing a support platform in the vicinity of, but above the bottom of the shaft;

(d) positioning a lift cab on said support platform;

(e) providing a lift drive machine in the shaft;

(f) coupling cables from said cable drums with the counterweight assembly while fixing one end of the coupled cables to said beam, said coupled cables being reeved over the pulley on said beam and over a drive pulley on the lift drive machine; and (g) raising the beams in the shaft by means of the hoist pulley means, and setting the beam at the top of the shaft by extending the beam arms into the support pockets.

2. The method of claim 1 wherein said beam, said counterweight assembly, and said guide rails are raised by said hoist pulley means to a first position above said lift cab to be suspended in the shaft at said first position to facilitate said cable coupling step.

3. The method of claim 2 comprising the step of mounting said guide rails in the shaft while raising said beam whereby a set of counterweight guide rails and a set of cab guide rails are erected in the shaft.

4. The method of claim 3 comprising the step of concurrently raising said counterweight to the top of the shaft with said beam.

5. The method of claim 4, comprising the further step of lowering said counterweight assembly from said beam to a point approximately half of the height of the shaft; entraining cable from said cable drums about guide pulleys mounted on said cable; and dead hitching the entrained cable to the cab.

6. The method of claim 5, comprising the additional step of lowering the counterweight further in the shaft to raise the cab sufficiently to transfer the dead hitch on the entrained cable from the cab to the shaft.

7. The method of claim 1 comprising the step of removing the hoist pulley means from shaft wall after said beam has been set in place in the shaft.

* * * * *